US005821847A

United States Patent [19]

Totsuka

[11] Patent Number: 5,821,847

[45] Date of Patent: Oct. 13, 1998

[54] FUSE AND METHOD OF MANUFACTURING SAME

[75] Inventor: Mitsuhiko Totsuka, Shizuoka, Japan

[73] Assignee: Yazaki Corporation, Tokyo, Japan

[21] Appl. No.: 824,983

[22] Filed: Mar. 27, 1997

[30] Foreign Application Priority Data

Mar. 29, 1996 [JP] Japan ..... 8-077231

[51] Int. Cl.[6] ..... H01H 85/06; H01H 85/11; H01H 69/02

[52] U.S. Cl. ..... 337/166; 337/198; 337/160; 29/623

[58] Field of Search ..... 337/198, 160, 337/290, 296, 295, 255, 260, 261–264, 162–166, 158–163, 252, 253; 29/44, 412, 445, 623

[56] References Cited

U.S. PATENT DOCUMENTS

| | | | |
|---|---|---|---|
| 4,944,084 | 7/1990 | Horibe et al. | 29/623 |
| 5,262,751 | 11/1993 | Kudo et al. | 337/296 |
| 5,294,906 | 3/1994 | Totsuka et al. | 337/260 |
| 5,345,211 | 9/1994 | Muramatsu et al. | 337/186 |
| 5,416,461 | 5/1995 | Totsuka et al. | 337/261 |
| 5,488,346 | 1/1996 | Kondo et al. | 337/198 |
| 5,528,213 | 6/1996 | Kondo et al. | 337/160 |

FOREIGN PATENT DOCUMENTS 3-13960 3/1991 Japan .

*Primary Examiner*—Leo P. Picard
*Assistant Examiner*—Anatoly Vortman
*Attorney, Agent, or Firm*—Morgan, Lewis & Bockius LLP

[57] ABSTRACT

To effectively prevent the efflux at the time of depositing a fusible metal, a fuse includes a clamping piece in the longitudinal middle portion of a fusible element, a fusible metal having a low melting point is clamped by and deposited on the clamping piece, in which the fusible metal is deposited on the fusible element while parts of the fusible metal exposed when fusible metal is clamped with the clamping piece, are covered with enclosing walls that are formed by bending the fusible element on both sides of the clamped part to the sides of the fusible metal.

8 Claims, 3 Drawing Sheets

FUSE AND METHOD OF MANUFACTURING SAME

BACKGROUND OF THE INVENTION

1. Field of the Invention

This invention relates to a fuse of such a structure as a fusible metal having a low melting point is clamped and deposited on a fusible element and a manufacturing method thereof.

2. Background

High-amperage fuses having melting-severing characteristics have been improved by retaining some metal with melting point which is lower than a fusible element, such as tin, lead, etc., in a longitudinal middle portion of the fusible element, thus by generating some alloy with diffused fusible metal, are proposed in Japanese Utility Model Publication No. Hei. 3-13960 and Unexamined Japanese Patent Publication No. Hei. 7-14494.

FIG. 2 shows an example of the conventional fuses similar to the above.

A fuse 1 includes a fusible element 5 having a band-plate shape, both ends of which are connected to terminals 2 and 3, respectively. The fusible element 5 is bent to form in substantially U-shaped manner, and has a pair of legs 5*a* and 5*c* which are formed integrally with the terminals 2 and 3. A fusing strip 5*b* is provided at the intermediate position between the legs 5*a* and 5*c*. The fusing strip 5*b* includes a fusing portion 6 having a reduced sectional area formed by reducing a width of the fusing strip 5*b*, a heat radiator plate 7 has an improved heat radiativity due to expansion of a surface area, and clamping pieces 8 for clamping a fusible metal 10 are formed on the side opposite to the heat radiation plate 7 to adjoin the fusing portion 6.

The clamping pieces 8 are formed integrally with the fusing strip 5*b* to extend both sides of a portion of the fusing strip 5*b* in width direction. The clamping pieces 8 are bent outwardly to clamp the chip-form fusible metal 10 on the fusing strip 5*b*. Then, some heat such as a light beam is applied to the clamping pieces 8, the fusible metal 10 becomes deposited on the fusing strip 5*b* of the fusible element 5 in the clamping piece 8. The deposition of this case is purposed to ensure an engagement of the fusible metal 10, increase an effect of contact to the fusible element 5 and to partially transform the fusible metal 10 into an alloy with the fusible element 5.

In the fuse 1, the fusible metal 10 is held at an intermediate portion of the fusible element 5. For example, at such time of start of a motor, the fusible element 5 does not melts if some heat generated in the fusible element 5 by instantaneous overcurrent in the circuit and the heat concentrates in the middle part since the heat is conducted to and absorbed by the fairly heat-conductive fusible metal 10. That is, the fusion-free rage against instantaneous overcurrent can be expanded.

When a low-amperage current, which is larger than the continuous permissible current of the electric wire used in the circuit but within the fusible range of the fusible element 5, is applied, normally a long melting-severing time is required since heat generation per unit time is small. However, the fusible metal 10 existing in the intermediate position of the fusible element 5, becomes into half-melted or melted condition and thus counter diffusion occurs between the fusible metal 10 and the fusible element 5, resulting with increase in heat generation amount per unit time caused by increase in volume resistance value, finally fusing is quickened by the heat conducted to the fusible element 5 entirely. That is, quickening of fusing in the low-amperage current range is effected.

In the case of the above fuse 1, although the fusible metal 10 is deposited on the fusible element 5 after the fusible metal 10 is clamped by the clamping pieces 8, there is a chance that the fusible metal 10 flows beyond the desired area.

FIGS. 3*a* and 3*b* each shows sectional view of the fusible metal 10. More specifically, FIG. 3*a* shows a case of favorable deposition and FIG. 3*b* shows a case of efflux of the fusible metal 10 beyond the desired area at the time of deposition. There is a problem that efflux of the fusible metal 10 as shown in FIG. 3*b* results with dispersion in the melting-severing characteristics and thus hindering the realization of uniformity in the quality of products.

As shown in FIG. 4, although the fusible element 5 having an efflux receiving depression 9 for placing the fusible metal 10, is described in Japanese Utility Model Publication No. Hei. 3-13960, there are some cases of efflux of the fusible metal 10. It is possible to prevent efflux of the fusible metal 10 to some extent by making the efflux receiving depression the deeper, however, on the contrary, there arises another problem that the manufacturing process of the efflux receiving depression 9 becomes the more difficult.

Although it is also possible to prevent efflux of the fusible metal 10 by enclosing the fusible metal 10 with another piece of parts, there is a chance that an increase in the costs may be resulted with by an increase in the number of parts.

SUMMARY OF THE INVENTION

An object of the present invention is to eliminate the above-described difficulties accompanying a conventional fuse. The object of the present invention has been achieved by a fuse and the manufacturing method thereof which effectively prevent efflux of the fusible metal at the time of deposition through elimination of dispersion in the melting-severing characteristics in such manner that the production process is simple without increase in the costs.

More specifically, the present invention provides a fuse including a clamping piece provided in the longitudinal middle portion of a fusible element, a fusible metal having a low melting point, clamped by and deposited on the clamping piece, in which the fusible metal is deposited on the fusible element in such a manner that parts of the fusible metal, which is exposed when fusible metal is clamped with the clamping piece, is covered with enclosing walls that are formed by bending the fusible element.

The fusible element has a band-plate shape, the clamping piece is formed integrally with the fusible element on at least one side breadthwise, the fusible metal is clamped on the fusible element by bending the clamping piece, and the enclosing walls are formed by bending the fusible element on both sides of the fusible metal toward the fusible metal.

The fusible element has a fusing portion formed by reducing a width of the fusible element and located so as to adjoin the position where the fusible metal is deposited.

Further, the present invention provides a manufacturing method of a fuse includes a step of providing a fusible element including a clamping piece positioned in a middle portion of the fuse element in a longitudinal direction, a step of clamping a fusible metal by the clamping piece, a step of bending the fusible element to cover portions of the fusible metal exposed to an outside of the clamped part after the clamping step, and a step of heating a part of the fusible element to deposit the fusible metal on the fusible element after the bending step.

According to the fuse of the invention, since the fusible metal is deposited while the fusible metal is covered with the enclosing walls, the fusible metal will not flow to the outside. When this fuse is manufactured, since the fusible metal is clamped first by bending the clamping piece integrally provided breadthwise on the fusible element in a band-plate shape and then the enclosing walls are formed by bending the fusible element on both sides in the same direction, the fusible metal can be covered in approximate full circumference and thus the fusible metal can be integrated with the fusible element while efflux of the fusible metal is prevented by depositing the fusible metal in that covered state. Additionally in this fuse, since the fusing portion is provided so as to adjoin the deposition part of the fusible metal, the heat generated at the flow of instantaneous overcurrent is absorbed efficiently by the fusible metal and thus the fusion-free rage against the instantaneous overcurrent is expanded. Moreover, at the time when low-amperage current flows, melting-severing at the adjoining fusing portion is quickened by diffusion effected by melting of the fusible metal and consequently melting-severing at the low-amperage current range is quickened to improve the melting-severing characteristics are improved.

DETAILED DESCRIPTION OF THE PREFERRED EMBODIMENT

A fuse and the manufacturing method thereof related to the present invention are described below in detail with references to the drawings.

Figure 1A:
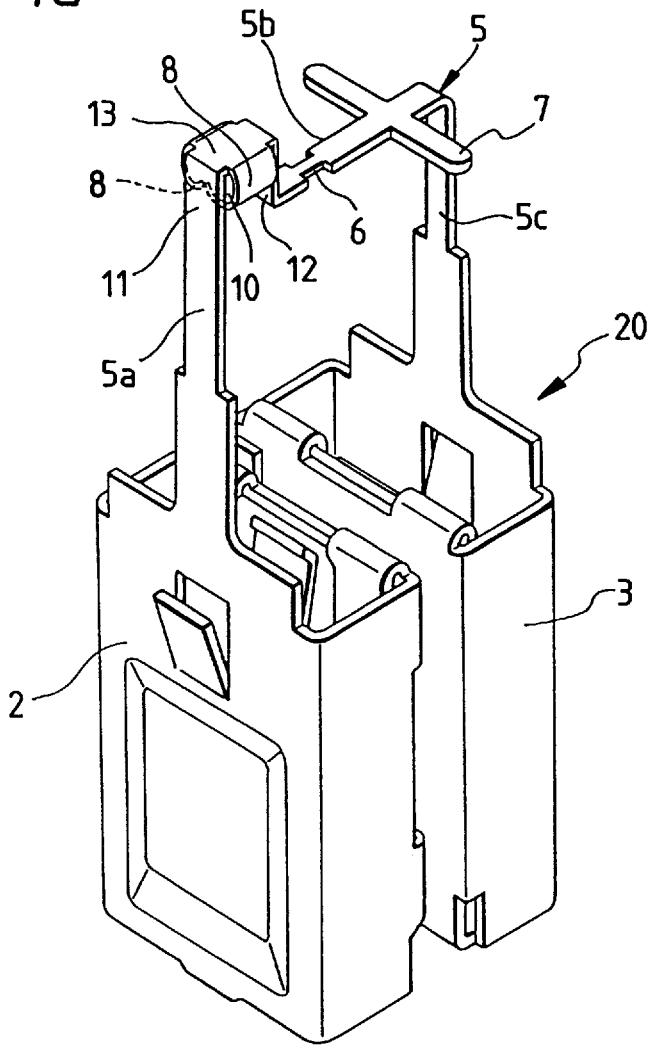
FIG. 1*a* is a perspective view showing a structure of a fuse of an embodiment of the present invention.

As shown in FIG. 1*a*, a fuse 20 includes a fusible element 5 having a band-plate shape, both ends of which are connected to terminals 2 and 3. The fusible element 5, is bent to form in substantially U-shaped manner, and has a pair of legs 5*a* and 5*c* which are formed integrally with the terminals 2 and 3, and a fusing strip 5*b* is provided between upper ends of the legs 5*a* and 5*c*.

A fusing portion 6 having a sectional area reduced by narrowing the strip width is formed in the longitudinal middle portion of the fusing strip 5*b*, and a heat radiator plate 7 having a surface area expanded for improvement in the heat radiativity is provided on one adjoining side while clamping pieces 8, for clamping a fusible metal 10 having a low melting point, are provided on the other adjoining side.

The clamping pieces 8 are formed integrally with both sides of the fusing strip 5*b* in width directions, which are -bent inwardly to form a deposition part 13 on the fusing strip 5*b*, whereon the fusible metal 10 formed as a chip is clamped.

The deposition part 13 of the fusible metal 10, constructed as described below, which protrudes upward and is slightly higher than the level of the fusing portion 6 and the heat radiation plate 7.

The deposition part 13 is constructed first by clamping the fusible metal 10 so as to be enclosed on the bottom side of the fusing strip 5*b* through bending downwardly the clamping pieces 8 which are formed integrally with the both sides of the fusing strip 5*b* of the fusible element 5. The fusing strip 5*b* still has a flat shape at this stage.

Figure 1B:
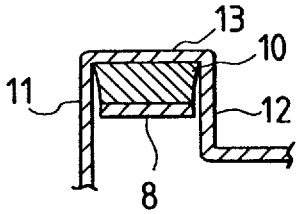
FIG. 1*b* is a sectional view showing a structure of a deposition part of a fusible metal.
Figure 2:
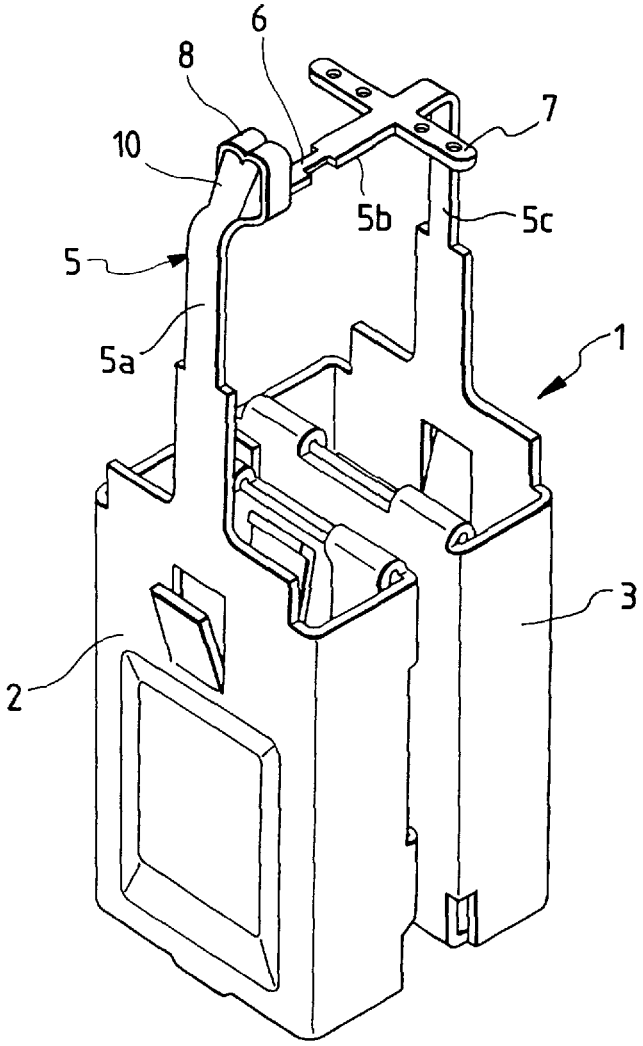
FIG. 2 PRIOR ART
FIG. 2 is a perspective view showing a structure of a conventional fuse.
Figure 3A:
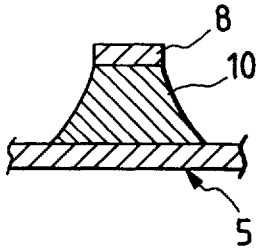
FIG. 3a PRIOR ART
FIG. 3*a* is a sectional view to show a case of little efflux of a fusible metal in FIG. 2.
Figure 3B:
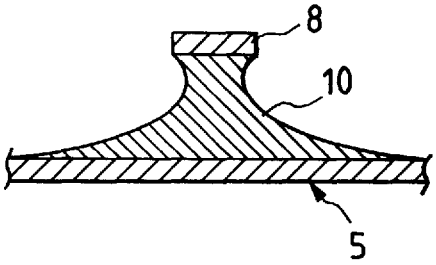
FIG. 3b PRIOR ART
FIG. 3*b* is a sectional view to show a case of a large efflux of the fusible metal in FIG. 2.
Figure 4:
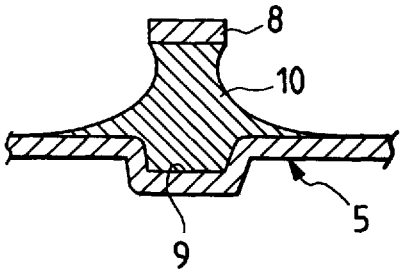
FIG. 4 PRIOR ART
FIG. 4 shows a sectional view to show an efflux of a fusible metal of another conventional fuse.

Next, at both approximate longitudinal ends of the fusible metal 10, as shown in FIG. 1*b*, plate portions corresponding to enclosing walls 11 and 12 are bent squarely to the side where on the fusible metal 10 is clamped. Thus, the enclosing walls 11 and 12 is formed so as to cover the end surfaces of the fusible metal 10 enclosed by the clamping pieces 8. The enclosing wall 11 is extended to form the leg 5*a* while the enclosing wall 12 is bent to form the fusing strip 5*b* extending to the fusing portion 6.

After completing the bending processes as described above, the part corresponding to the deposition part 13 is heated by such as light beam to deposit the fusible metal 10, the approximate full circumference of which is enclosed with the clamping pieces 8 and the enclosing walls 11 and 12, onto the fusible element 5. Excessive efflux of the fusible metal 10 at the time of deposition is thus prevented and the deposition of the fusible metal 10 within a predetermined area is ensured. Consequently, dispersion in the melting-severing characteristics is prevented and the product quality is improved.

The enclosing walls 11 and 12 are formed by bending the fusible element 5 without restrictions in the configuration and forming positions. The clamping pieces need not to be provide on both side edges, and extension from either of the side edges is sufficient.

As discussed above, in the fuse according to the present invention, since the fusible metal is deposited while the fusible metal is enclosed and covered with walls, efflux of the fusible metal at the time of deposition can be prevented effectively. Consequently, dispersion in the melting-severing characteristics can be eliminated and the product quality is improved. Additionally, since the enclosing walls are formed only by bending the fusible element, the processing is simple and the melting-severing characteristics can be improved surely and for low costs in comparison with a covering of the fusible metal with another piece of parts or a provision of the efflux receiving depression for prevention of the flow.

Moreover, the approximate full circumference of the fusible metal can be enclosed by simply bending both sides of the fusible element after the clamping pieces are bent to clamp the fusible metal and the efflux of the fusible metal can be effectively prevented by deposition in that state.

Since the fusing portion adjoins the deposition part of the fusible metal, the fusion-free rage against the instantaneous overcurrent can be expanded while the fusion in the low-amperage current range can be quickened, and thus the melting-severing characteristics also can be improved.

What is claimed is:

1. A fuse, comprising:

a fusible element including a base portion and a pair of leg portions connected together through said base portion;

a clamping piece formed in a longitudinal middle portion of said base portion;

a fusible metal clamped with said clamping piece;

a first enclosing wall formed by bending one of said leg portions; and a second enclosing wall formed by bending said base portion, wherein said fusible metal is deposited on said base portion so that parts of said fusible metal exposed when said fusible metal is clamped with said clamping piece, is covered by said first and second enclosing walls.

2. The fuse of claim 1, wherein said fusible element has a band-plate shape, said base portion is formed integrally with said clamping piece on a side thereof, and wherein said fusible metal is clamped on said base portion by bending said clamping piece.

3. The fuse of claim 1, wherein said first and second enclosing walls are positioned on both sides of said fusible metal.

4. The fuse of claim 1, further comprising a fusing portion formed by reducing a width of said fusible element, said fusing portion being located so as to adjoin a position where said fusible metal is deposited.

5. A method of manufacturing a fuse, comprising the steps of:

providing a fusible element including a clamping piece positioned in a longitudinal middle portion of the fusible element having a pair of leg portions;

clamping a fusible metal by the clamping piece;

bending one leg of the fusible element around exposed portions of the fusible metal to cover the exposed portions of the fusible metal; and depositing the fusible metal on the fusible element.

6. The method of claim 5, wherein the depositing step includes a step of heating a part of the fusible element.

7. The method of claim 5, wherein the fusible element is bent to cover both sides of the fusible metal in the step of bending one leg of the fusible element.

8. A fuse, comprising:

a fusible element having a pair of leg portions;

a clamping piece formed in a longitudinal middle portion of the fusible element;

a fusible metal having a low melting point and clamped by the clamping piece; and enclosing walls formed by bending the leg portion of the fusible element, wherein the fusible metal is deposited on the fusible element so that parts of the fusible metal exposed when the fusible metal is clamped with the clamping piece are covered by the enclosing walls, and wherein the fusible element has a fusing portion that is narrower than other portions of the fusible element.

* * * * *